United States Patent [19]

Maguire

[11] 4,355,729

[45] Oct. 26, 1982

[54] SINGLE SERVICE CHILDPROOF CLOSURE

[76] Inventor: Daniel J. Maguire, 323 W. Waverly Rd., Glenside, Pa. 19038

[21] Appl. No.: 225,306

[22] Filed: Jan. 15, 1981

[51] Int. Cl.[3] ..... B65D 55/02

[52] U.S. Cl. ..... 215/215; 215/211; 215/253; 215/302; 215/355; 220/284

[58] Field of Search ..... 215/211, 215, 292, 296, 215/302, 250, 255, 253; 220/266, 284, 307

[56] References Cited

U.S. PATENT DOCUMENTS

| | | | |
|---|---|---|---|
| 4,185,747 | 1/1980 | Goncalves | 215/253 |
| 4,226,334 | 10/1980 | Weiler et al. | 215/355 |
| 4,231,486 | 11/1980 | Bock | 215/250 X |

*Primary Examiner*—George T. Hall

*Attorney, Agent, or Firm*—Weiser, Stapler & Spivak

[57] ABSTRACT

A single service childproof container closure for closing the nozzle of a plastic or other container comprising a non-removable closure having a non-replaceable breakaway cap for implant into the nozzle of a container.

7 Claims, 5 Drawing Figures

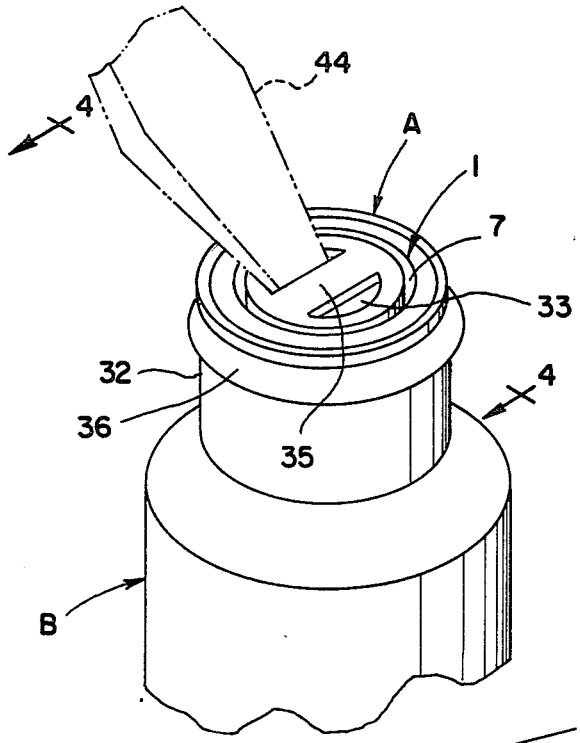
FIG. 1
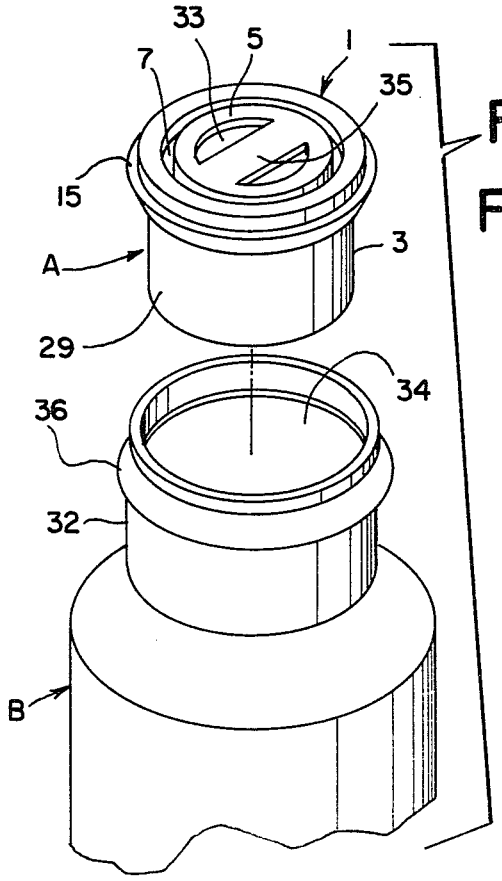
FIG. 2
FIG. 3
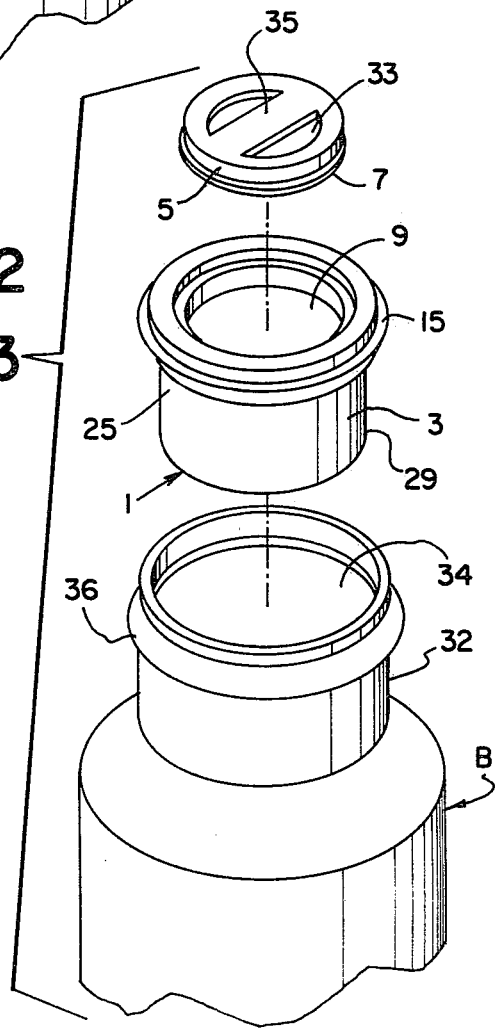

SINGLE SERVICE CHILDPROOF CLOSURE

BACKGROUND OF THE INVENTION

The present invention relates generally to the field of childproof closures, and more particularly to a single service childproof container closure of unitary, non-removable design having a nonreplacable, breakaway cap, to expose the contents stored within a container.

Numerous attempts have been made in the field of tamperproof or childproof container closures, to develop suitable replacable caps or closures for bottles containing medicines. In non-medicinal storage containers, it has been known to use non-replacable cap closures. The closures employed on soft drink bottles and beverage cans are exemplary of this type of closure. However, these non-medicinal uses have never included a child resistant feature inasmuch as such construction was never considered necessary.

Previous attempts at single-use closures have primarily been directed to tamperproof closures, that is, closures which will be deformed or destroyed upon opening. Such closures have been developed in an effort not to allow the tampering with materials in the associated containers to go unobserved.

Recent government regulations promulgated for the safety of consumers, and particularly children, have increased efforts to design and manufacture a childproof closure which is simple in operation, inexpensive in production and which can be easily affixed during assembly line processing of unit containers in a variety of industries. Such industries include, among others, the pharmaceutical, petroleum, cosmetic, household, industrial cleaner and paint industries. No container closure filling the needs common to such a wide variety of materials has heretofore had such advantageous properties as to have gained general application.

Attempts of the prior workers in the art have generally suffered from drawbacks wherein a totally acceptable single service, childproof closure has yet to be developed. Prior art closures have proved deficient in that some lack the strength and ease of use required in the mass production packaging of products. Others fail when compressed under pressure or when subjected to the rigors of commercial shipping and transport. Thus, by having less strength than may be essential, prior forms of closures may constitute inadequate protection to maintain the hygenic protection of the materials packaged therein or to prevent the opening by children and the consequent dangers. Other prior art devices have tended to be so complicated in operation or so costly as to discourage wide use.

The Federal governmental regulations dealing with child resistant container closures have resulted in the design and manufacture of a great number of closures, all of which have been designed particularly with the Federal regulations in mind. Considerable time, effort and costs have been expended in the packaging industry and great strides have been made toward achieving the desired goals. At the present time, there are many acceptable child resistant closures for containers filled with products posing possible dangers to children. These closures have been tested and approved in accordance with established criteria and literally millions of such closures have been manufactured and used to date. All of the existing, approved, child resistant closures have a common drawback, that is, they are all relatively more costly than the non-child resistant types of closures they are designed to replace. In the case of certain medicines and industrial products wherein repeated use is contemplated, the additional cost of the newer types of closures is not an important factor, and the safety to children consideration is paramount. However, in those cases wherein the container will be filled with a single service item, that is, where there is no likelihood of repetitious use, then a relatively expensive, child resistant closure, to be used only one time, does not make good economic sense. Products such as brake fluid, automotive gas additives and similar items are typical of materials packaged in single service containers. There continues to exist a real need to provide a reliable, approved, inexpensive, childproof, single service closure.

SUMMARY OF THE INVENTION

The present invention relates generally to a single service childproof container closure of unitary design, and more particularly, to a single unit, non-removable closure, having a non-replacable, breakaway cap.

The closure of the present invention comprises a male fitting designed to be used in combination with a female receptable, that is, the nozzle of a container. The principle of operation requires the wall of the closure to be flexible to a degree and constructed of a material suitable to resist permanent deformation. Molded polyethylene plastic, polypropylene plastic and other plastics have proved satisfactory for this use. In a preferred embodiment, the nozzle is molded, formed or otherwise treated to provide an interior, recessed peripheral groove of complimentary configuration in the interior wall of the receptable nozzle. The male fitting or closure comprises a generally hollow cylindrical body that is molded or otherwise formed with a complimentary peripheral flange. When the male fitting is pressed downwardly into the nozzle, the flange will be forced into the groove in a tight, sealed, substantially non-removable engagement. The flange and groove configurations make removal of the closure difficult or even impossible without permanent damage. The natural resiliency of the closure material assures a tight seal once the male fitting is properly seated within the nozzle for container closure purposes.

Non-resealable opening of the closure to gain access to the container contents is accomplished by prying off the breakaway cap which forms an integral part of the single unit closure. The breakaway cap is integrally molded in the male fitting and has continuity with the sleeve portion of the closure through a weakened joint in the material of which the male fitting is formed. The cap is essentially a circular, disc-like member which is integral with the remainder of the male fitting when the container is filled and sealed and which can be easily, permanently removed by employing a readily available tool when it is desired to use the container contents.

The removable cap is preferably formed to have a recess and bar or other construction formed in its exterior face within which the blade of a knife, screwdriver, can opener or other convenient household implement may be inserted and levered so as to pry off the cap from the remainder of the male fitting by breaking the weak joint. Once the cap has been removed, it can no longer be associated with the male fitting to provide a seal and the container will be permanently opened.

It is therefore an object of the present invention to provide an improved childproof safety closure for containers.

It is another object of the present invention to provide a novel container closure which is particularly suitable for containers holding contents which constitute a single portion, dose or unit, such as individual medicine portions, lubricants, brake fluids, gasoline additives, etc.

It is another object of the present invention to provide a novel single use childproof closure which is of single unitary construction in such form as to be easily and rapidly implanted in a container nozzle by industrial assembly line techniques, utilizing existing container packaging equipment.

It is another object of this invention to provide a novel, childproof, container closure utilizing the natural resiliency of the material to assure tight sealing.

It is another object of this invention to provide a novel, childproof container closure which employs operating components of different diameters, parts of which cooperate with the interior construction of a container to complete the sealing function.

It is another object of this invention to provide a novel container closure that is inexpensive in manufacture, simple in operation and reliable when in use.

Other objects and a fuller understanding of the invention will be had by referring to the following description and claims drawn to a preferred embodiment thereof, taken in conjunction with the accompanying drawings, wherein like reference characters refer to similar parts throughout the several views, and in which:

BRIEF DESCRIPTION OF THE DRAWINGS

FIG. 1 is an isometric view of a preferred embodiment of the closure in a container nozzle.

FIG. 2 is a partially exploded isometric view of the closure and container nozzle of FIG. 1.

FIG. 3 is a view similar to FIG. 2, showing the breakaway cap separated from the male fitting.

DESCRIPTION OF THE PREFERRED EMBODIMENTS OF THE INVENTION

Figure 4:
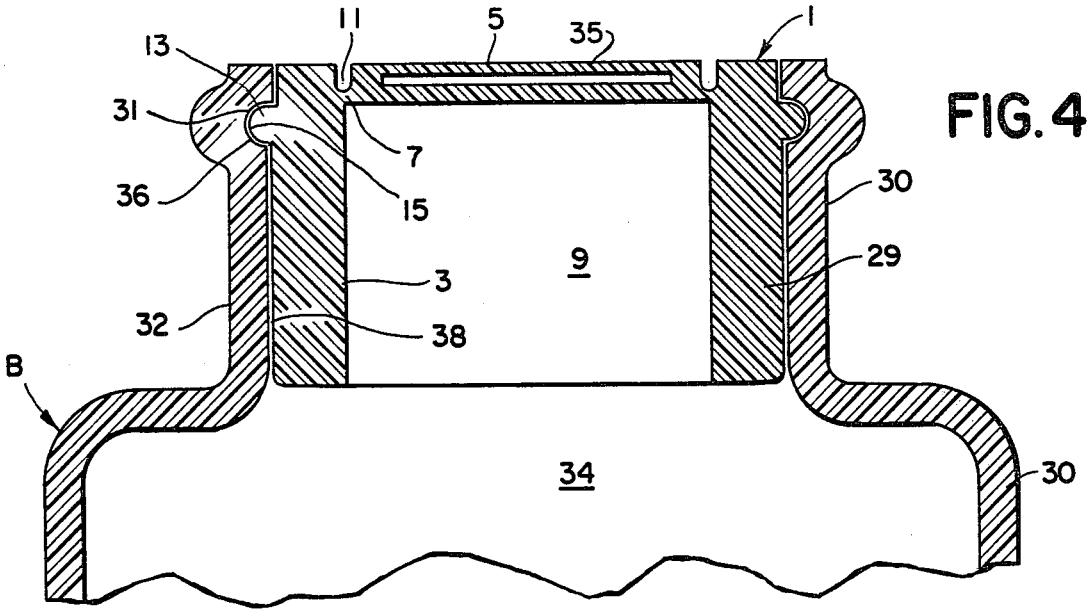
FIG. 4 is an enlarged, cross-sectional view taken along line 4—4 of FIG. 1.

Although specific terms are used in the following description for the sake of clarity, these terms are intended to refer only to the particular structure of the invention selected for illustration in the drawings, and are not intended to define or limit the scope of the invention.

As shown in the drawings, the single use childproof closure generally designated as A essentially comprises a male fitting 1 which is designed for irreversible insertion into the nozzle 32 of a container generally designated as B. The closure is fabricated from a flexible, resilient material having a relatively firm body such as polyethylene plastic, polypropylene plastic or other suitable plastic material. The container may be of unyielding material such as metal, glass or may be conventional plastic.

Referring now to FIGS. 1–3, the male fitting 1 is illustrated as a unitary member having as an integral part of its structure, a non-removable sleeve member 3 and an integral breakaway cap 5. The sleeve member 3 is generally of hollow cylindrical configuration and the cap 5 is generally disc-like in configuration as modified to provide the prying bar 35 as hereinafter more fully set forth. The cap 5 forms the upper enclosing surface of the male fitting 1 and is removable, but not replaceable, by forcibly breaking the weak joint 7 which integrally connects the breakaway cap 5 about its perimeter to the sleeve member 3 of the fitting.

The sleeve member 3 is permanently implanted as an integrally formed unit with the breakaway cap, into the nozzle 32 of a container, after the container is filled to provide a permanent closure and seal. The container neck or nozzle is suitably formed, as more fully described below, to permanently lock into position the sleeve member 3 after is has been inserted into the container and fully seated.

The breakaway cap 5 and the walls 29 of the sleeve member 3 are integrally joined at the weak joint 7 and define an interior cavity space 9. The interior cavity space communicates with the interior space 34 of the container into which the male fitting 1 has been introduced.

As is best illustrated in FIG. 4, the non-removable sleeve member 3 of the closure is designed to have a closure lock 13 which comprises a peripheral flange 15 which extends radially outwardly from the outside of the wall 29 of the sleeve member. The container nozzle 32 is molded or otherwise formed to provide a peripheral recess 36 of complimentary design which extends radially outwardly from the interior wall 38. The dimensions of the sleeve member flange are designed slightly greater than the dimensions of the peripheral recess 36 to assure a tight engagement and positive seal after the parts are assembled. The natural resiliency of the material comprising the male fitting 1 and the container nozzle 32 cooperate to stretch and shrink as necessary to permit assembly of the male fitting 1 within the nozzle 32.

The closure flange 15 extending radially outwardly from the side wall 29 of the sleeve member 3 may take the form of a rounded moulding, as is best seen in FIG. 4, which fits into the peripheral groove 36 which is fabricated of complimentary shape and dimension to retain the flange 15.

Figure 5:
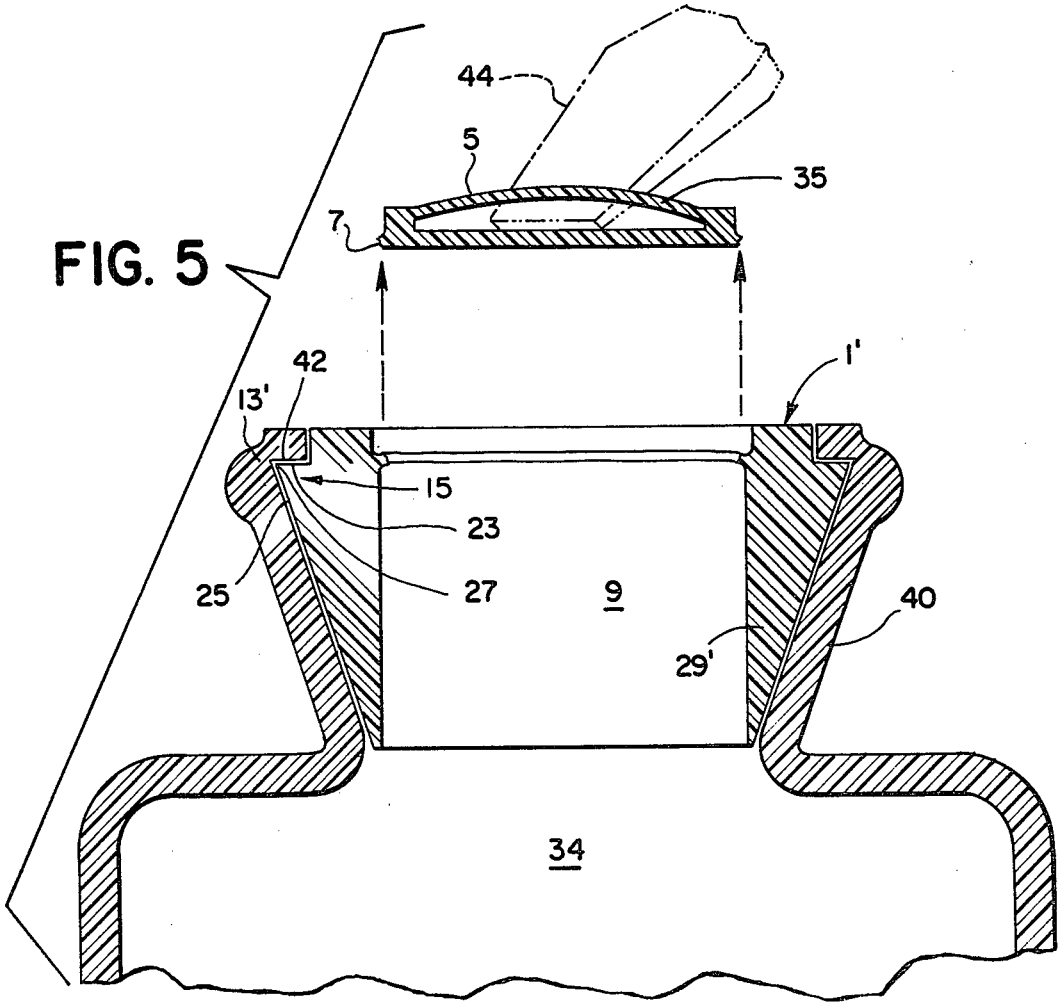
FIG. 5 is a cross-sectional view similar to FIG. 4 showing the breakaway cap removed and a modified locking construction.

In another embodiment, as illustrated in FIG. 5, the closure lock 13 may be constructed to have a shouldered leading edge 25 which extends from the exterior of the side walls 29' of the modified fitting 1'. The leading edge terminates in an arrow-like, acute angle edge 27 which forms an upwardly facing horizontal locking surface 23.

In either embodiment, the closure lock includes an exterior inserting face 25 and a radially projecting exterior locking surface which tightly contacts a recess in the nozzle wall in sealing, non-removable engagement. Where the uppermost locking surface 23 of the flange 15 is horizontal, as in FIG. 5, the upper wall 42 of the recessed nozzle groove 36 is formed to the configuration of a downwardly facing horizontal face to provide an immovable opposing surface to thereby render impossible the removal of the protective closure 1' once it has been inserted.

To more securely lock the protruding flange of the closure into the nozzle groove of the container, the diameter of the flange is preferably fabricated slightly larger than that of the groove, thus creating an opposing, radially directed force which enhances the strength of the closure lock.

The connection of the breakaway cap 5 to the remainder of the sleeve member 3 is defined by a weak joint 7 (FIG. 4). A trough 11 is cut or otherwise formed in the top of the male fitting 1, 1' to provide the weak joint 7. The weakened joint 7 contemplated by the invention may be formed by any process known to those skilled in the art of forming plastics or the like to allow the cap 5 to be separated by prying when so desired. Non-resealable opening of the closure to gain access to the container contents is accomplished by prying off the breakaway cap 5 which is an integral part of the single unit closure.

As a principal feature of the invention, the cap 5 has continuity with the vertical implant sleeve portion 3 of the male fitting closure 1, 1' through a weakened joint 7 which is formed in the material of which the closure A is formed. Thus, the cap 5 is essentially a circular, removable, central portion of the upper enclosing construction of the invention.

The central opening through the male fitting 1, 1' which is formed by removal of the breakaway cap 5 is sufficiently large in diameter to permit the contents of the container to be effectively poured. The breakaway cap 5 is preferably formed to include a pair of prying slots 33 in its exterior, upwardly facing surface. An intermediately positioned fulcrum bar 35 is integrally molded or otherwise formed to extend across the diameter of the cap 5. To remove the cap 5, a knife, screwdriver, can opener or other household implement 44 may be inserted and levered so as to break the weak joint 7 whereby the cap 5 can be completely, permanently removed from association with the remainder of the male fitting 1, 1'.

Although the invention has been described with a certain degree of particularity, it is understood that the present disclosure has been made only by way of example and that numerous changes in the details of construction and the combination and arrangement of parts may be resorted to without departing from the scope of the invention.

What is claimed is:

1. A single service childproof container closure of the type containing a nozzle comprising a non-removable, resilient closure which is implanted into the nozzle of the container, said closure comprising a cylindrical sleeve member of uniform diameter, the sleeve member having a peripheral flange which is adapted to seat within a corresponding peripheral groove formed in the nozzle, said closure comprising a non-replacable breakaway cap, said cap being defined from the remainder of the closure by a weakened seam, the dimensions of the closure flange being slightly greater than the dimensions of the nozzle groove whereby the closure is tightly secured within the nozzle in a non-removable manner, the cap comprising means to pry the cap relative to the nozzle to remove the cap from the remainder of the closure by separating the cap along the said weakened seam.

2. A single service childproof container closure of the type having a nozzle comprising a non-removable closure which is implanted into the nozzle of the container, said closure having a peripheral flange which is adapted to seat within a corresponding peripheral groove formed in the nozzle, said closure comprising a non-replacable breakaway cap, said cap being defined from the remainder of the closure by a weakened seam, the cap including means to pry the cap relative to the nozzle to remove the cap from the remainder of the closure by separating the cap along the said weakened seam, the means to pry comprising a fulcrum bar extending across the top.

3. The container claimed according to claim 2 wherein the fulcrum bar is defined from a portion of the cap by a prying recess, the said recess being adapted to receive a prying tool between the fulcrum bar and the portion of the cap whereby the tool can be leveraged sufficiently to break the weakened seam to remove the cap.

4. The container claimed according to claim 2 wherein the weakened seam comprises a circular trough formed in the top of the closure, the cap being connected to the remainder of the closure at the bottom of the trough.

5. The container claimed according to claim 2 wherein the closure includes a tapered inserting face and the nozzle includes a corresponding inclined sidewall to receive the closure.

6. The container claimed according to claim 5 wherein the inserting face terminates upwardly in a radially outwardly projecting, exterior locking surface.

7. The container claimed according to claim 6 wherein the sidewall of the nozzle comprises a shaped groove to receive therein the closure locking surface in non-removable engagement.

* * * * *